US008854267B2

(12) United States Patent
Kim et al.

(10) Patent No.: US 8,854,267 B2
(45) Date of Patent: Oct. 7, 2014

(54) ANTENNA DEVICE FOR A PORTABLE TERMINAL

(75) Inventors: Jae-Hee Kim, Gyeonggi-do (KR); Dong-Hyun Lee, Gyeonggi-do (KR); Se-Hyun Park, Gyeonggi-do (KR); Austin Kim, Gyeonggi-do (KR); Joon-Ho Byun, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 191 days.

(21) Appl. No.: 13/440,283

(22) Filed: Apr. 5, 2012

(65) Prior Publication Data

US 2012/0268328 A1 Oct. 25, 2012

(30) Foreign Application Priority Data

Apr. 22, 2011 (KR) ..... 10-2011-0037897

(51) Int. Cl.

| | |
|---|---|
| ***H01Q 1/24*** | (2006.01) |
| ***H01Q 5/00*** | (2006.01) |
| ***H01Q 13/10*** | (2006.01) |
| ***H01Q 9/42*** | (2006.01) |
| ***H01Q 1/48*** | (2006.01) |
| ***H01Q 9/04*** | (2006.01) |
| ***H01Q 7/00*** | (2006.01) |

(52) U.S. Cl.

CPC ..... *H01Q 5/0055* (2013.01); *H01Q 1/243* (2013.01); *H01Q 13/10* (2013.01); *H01Q 9/42* (2013.01); *H01Q 1/48* (2013.01); *H01Q 9/0421* (2013.01); *H01Q 7/00* (2013.01); *H01Q 5/0062* (2013.01)

USPC ..... 343/702; 343/728

(58) Field of Classification Search

CPC ..... H01Q 1/243; H01Q 9/0421; H01Q 1/48; H01Q 13/10; H01Q 7/00

USPC ..... 343/702, 866, 741, 767, 728

See application file for complete search history.

(56) References Cited

U.S. PATENT DOCUMENTS

| | | | | |
|---|---|---|---|---|
| 6,686,886 | B2 * | 2/2004 | Flint et al. | 343/702 |
| 7,612,725 | B2 | 11/2009 | Hill et al. | |
| 7,701,401 | B2 * | 4/2010 | Suzuki et al. | 343/702 |
| 7,843,396 | B2 | 11/2010 | Hill et al. | |
| 2007/0139270 | A1 * | 6/2007 | Takei et al. | 343/700 MS |
| 2010/0007564 | A1 * | 1/2010 | Hill et al. | 343/702 |
| 2011/0001673 | A1 * | 1/2011 | You et al. | 343/702 |

* cited by examiner

*Primary Examiner* — Hoanganh Le

(74) *Attorney, Agent, or Firm* — Cha & Reiter, LLC.

(57) ABSTRACT

An antenna device for improving antenna performance of a portable terminal having a metal edge installed on a case frame is disclosed. The antenna device includes a main board equipped with a power supply end for supplying power and a ground surface for grounding the main board, a loop radiator connected with the power supply end of the main board at first end and connected with the ground surface of the main board at a second end, and a metal body disposed along an edge of the portable terminal and electrically connected with the ground surface of the main board.

20 Claims, 10 Drawing Sheets

ANTENNA DEVICE FOR A PORTABLE TERMINAL

CLAIM OF PRIORITY

This application claims, pursuant to 35 USC §119, priority to, and the benefit of the earlier filing date of, that patent application filed in the Korean Intellectual Property Office on Apr. 22, 2011 and assigned Serial No. 10-2011-0037897, the entire disclosure of which is incorporated by reference, herein.

BACKGROUND OF THE INVENTION

1. Field of the Invention

The present invention relates to the field of portable terminals and more particularly to an antenna device for improved performance.

2. Description of the Related Art

Portable terminals, such as mobile communication terminals (e.g., cellular phones), electronic schedulers, and personal complex terminals have developed into an important means of information transmission. With the rapid expansion of wireless communications, mobile communication terminals have expanded their field of operation to provide not only voice communication but also data communication (e.g., text) and internet access. In addition, the field of mobile communication terminals is every changing as new functions and features are being added to the terminals as the wireless communication network capacity increases.

Thus, functions have been continually added to the mobile communication terminal (i.e., portable terminal) while the portable terminal itself has become lighter, thinner, more compact, and generally smaller. Thus, it is becoming more and more difficult to mount a plurality of components in the limited space of the portable terminal as the portable terminal is being reduced in size.

As the portable terminal communicates over a wireless network, an antenna is required to be installed in the portable terminal to perform communication services, such as a telephone conversation service and an Internet service. In general, the larger the antenna the better the performance of the antenna and, consequently, the performance of the portable terminal.

However, it is becoming increasingly more difficult to implement an antenna with a desired performance in the limited space of the latest generation portable terminals.

In addition, the current generation of portable terminals is being fabricated with a metal body installed on a case frame. This metal body results in a degradation of antenna performance.

SUMMARY OF THE INVENTION

An aspect of the present invention is to solve at least the above-mentioned problems and/or disadvantages and to provide at least the advantages described below. Accordingly, an aspect of the present invention is to provide an antenna device for a portable terminal, for allowing a metal body which is mounted on a case frame not to degrade antenna performance.

Another aspect of the present invention is to provide an antenna device capable of enhancing antenna performance for a portable terminal, using a metal body that is mounted on a case frame.

In accordance with another aspect of the present invention, an antenna device for a portable terminal is provided. The antenna device includes a main board equipped with a power supply end for supplying power and a ground surface for grounding the main board, a loop radiator which is connected with the power supply end of the main board at its one end and is connected with a ground surface of the main board at its other end, and a metal body which is disposed along an edge of the portable terminal and is electrically connected with the ground surface of the main board.

In accordance with one aspect of the invention, a portable terminal comprising an antenna device is disclosed. The antenna device comprises a main board equipped with a power supply end for supplying power and a ground surface for grounding the main board, a loop radiator connected to the power supply end of the main board at a first one end and connected to the ground surface of the main board at a second end, a metal body disposed along an outside edge of the portable terminal, the metal body being electrically connected to the ground surface of the main board, a slot surrounded by the ground surface of the main board and the metal body, and at least one stub, each of the at least one stub being electrically connected to one of the metal body and the ground surface of the main board, wherein the loop radiator is positioned on the slot and the at least one stub is vertically spaced from the loop radiator.

In accordance with another aspect of the invention, a portable terminal comprising an antenna device is disclosed. The antenna device comprises a main board equipped with a power supply end for supplying power and a ground surface for grounding the main board, a loop radiator connected to the power supply end of the main board at a first one end and connected to the ground surface of the main board at a second end, a metal body disposed along an outside edge of the portable terminal, the metal body being electrically connected to the ground surface of the main board and a radiation plate, containing a slot therein, the radiation plate being vertically spaced apart from the loop radiator and electrically connected with one of the metal body and the ground surface of the main board.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION

Exemplary embodiments of the present invention will be described herein with reference to the accompanying drawings. In the following description, well-known functions or constructions are not described in detail since they would obscure the invention in unnecessary detail. Also, the terms used herein are defined according to the functions of the present invention. Thus, the terms may vary depending on a user's or an operator's intentions and usage. That is, the terms used herein must be understood based on the descriptions made herein. Also, terms described herein, which are defined considering the functions of the present invention, may be implemented differently depending on user and operator's intention and practice. Therefore, the terms should be understood on the basis of the disclosure throughout the specification. The principles and features of this invention may be employed in varied and numerous embodiments without departing from the scope of the invention.

Furthermore, although the drawings represent exemplary embodiments of the invention, the drawings are not necessarily to scale and certain features may be exaggerated or omitted in order to more clearly illustrate and explain the present invention.

Among the terms set forth herein, a portable terminal (or terminal) refers to any kind of device capable of processing data that is transmitted or received to or from any external entity. The terminal may display icons or menus on a screen to which stored data and various executable functions are assigned or mapped. The terminal may include a computer, a notebook, a tablet PC, a mobile device, and the like.

The present invention described hereinafter relates to an antenna device for a portable terminal, for allowing a metal edge which is installed on a case frame not to degrade antenna performance but to enhance antenna performance.

Figure 1:
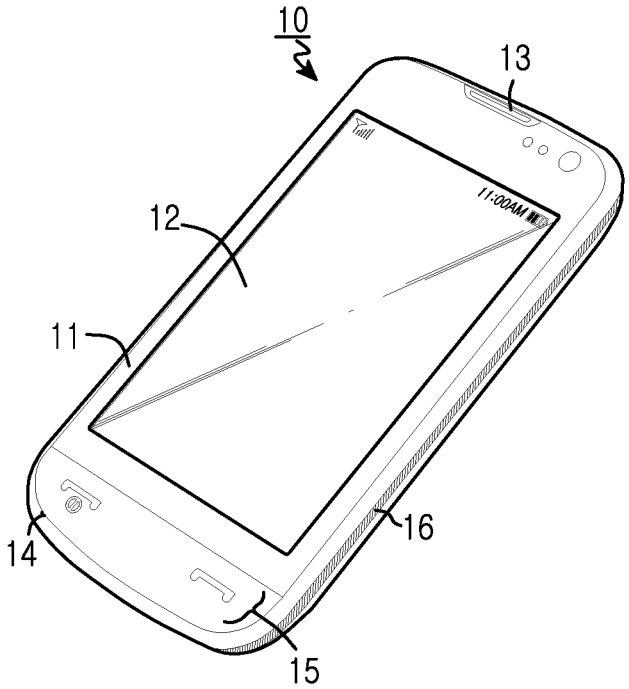
FIG. 1 is a perspective view of a portable terminal according to a first embodiment of the present invention.

FIG. 1 is a perspective view of a portable terminal according to one embodiment of the present invention.

Referring to FIG. 1, the portable terminal 10 includes a case frame 11 for forming the appearance of the portable terminal 10 and components (not shown), installed within the case frame 11. The portable terminal 10 includes a display 12 for presenting an image to a user, a speaker 13 for outputting an audio signal, a microphone 14 for inputting an audio signal, and a key button 15 which is an input means. The display 12 may be at least one of a Liquid Crystal Display (LCD), Light Emitting Diode (LED), an Organic Light Emitting Diode (OLED) or other similar type displays. In addition, the display 12 may include a touch screen, which allows a user to interactively enter inputs or commands to the portable terminal 10. Touch screen technology is well-known in the art and need not be presented in detail herein.

The case frame 11 includes a metal edge 16 for beautifying the appearance of the portable terminal. However, a conventional metal edge 16 electromagnetically interacts with a main electronic board, and may result in degradation of the performance of an embedded antenna (not shown). That is, the metal edge 16 could interfere with the operation of the embedded antenna.

An antenna device according to a first embodiment of the present invention for reducing the interference caused by the metal edge has the following composition; a slot radiator equipped with the metal edge 16 and a ground surface of a main board. In addition, the antenna device according to an embodiment of the present invention includes a loop radiator for magnetically coupling with the slot radiator. The loop radiator receives power from the main board and radiates radio waves. The slot radiator is magnetically coupled by the radiation generated by the loop radiator. Also, the antenna device according to an embodiment of the present invention may further include a stub for antenna matching.

Figure 2A:
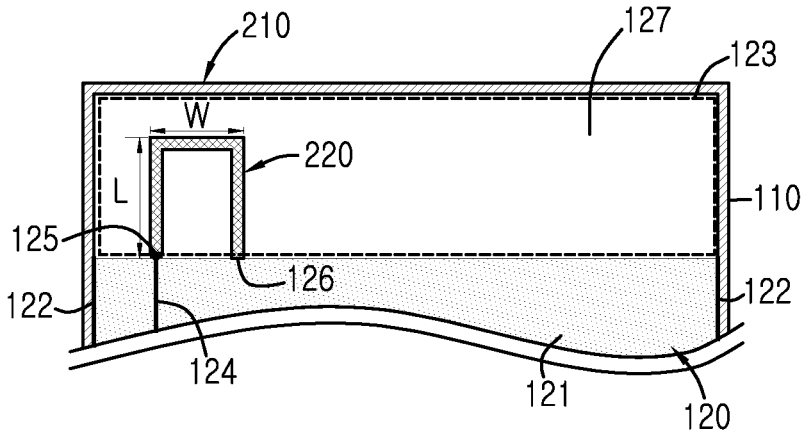
FIGS. 2A and 2B illustrate structures of an antenna device for a portable terminal according to a first embodiment of the present invention.
Figure 2B:
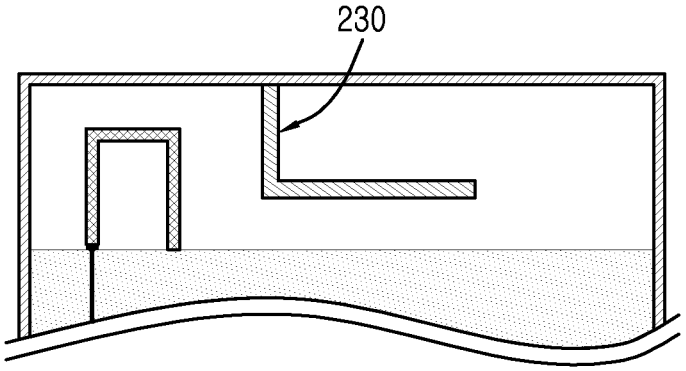

FIGS. 2A and 2B illustrate structures for an antenna device incorporated into a portable terminal according to one embodiment of the present invention.

FIG. 2A represents a top view of an antenna device for a portable terminal according to a first embodiment of the present invention that includes a slot radiator 210 and a loop radiator 220. The loop radiator 220 is magnetically coupled to the slot radiator 210. The slot radiator 210 includes a thin space, i.e., a slot 123, installed in a large metal plate. The slot radiator 210 operates as an antenna at a driving frequency. The slot 123 radiates electromagnetic waves. The shape and size of the slot 123, as well as the driving frequency, determine the radiation distribution pattern.

The slot 123 is an area surrounded by a ground surface 121 of a main board 120 and a metal edge 110 of a case frame that forms an outside surface of the portable terminal. Slot radiators are well-known in the art and need not be discussed in further detail herein. The loop radiator 220 is positioned on the slot.

In addition, the ground surface 121 of the main board 120 and the metal edge 110 of the case frame that forms an outside surface (or edge) of the portable terminal, are electrically coupled beside the part of the slot 123, and the slot radiator 210 according to an embodiment of the present invention is formed. The ground surface 121 of the main board 120 and the metal edge 110 may be electrically connected by a means 122. Means 122 may, for example, be a physical electrical contact or a solder connection or other similar connections that provide for electrical conductivity. The remaining surface of the main board 127, which is not within the area of the grounded surface 121 is referred to as an ungrounded surface of the main board. The ungrounded surface is a surface which is not grounded.

The loop radiator 220 includes a loop having any one of a plurality of shapes (e.g., a rectangle, a square, a triangle, and a circle). One end (e.g., a first end) 125 of the loop radiator 220 is electrically connected with a power supply line 124 of the main board 120, and the other end 126 (e.g., a second end) of the loop radiator 220 is electrically connected to the ground surface 121 of the main board 120. The loop radiator 220 may be deposited on the main board 120. As would be understood, the slot radiator 210 is magnetically coupled to the loop radiator 220 through the radiation generated by the loop radiator 220. In one aspect of the antenna device shown, a first resonance and a second resonance frequency (or frequency range(s)) may be simultaneously excited. Factors in determined the coupling of the loop radiator 220 with the slot radiator 210 are determined according to a size (a length (L)×a width (W)) of the loop radiator 220. With an appropriate selection of size of the loop radiator 220, a desired level of antenna matching may be achieved.

Referring to FIG. 2B, the antenna device for the portable terminal according to one embodiment of the present invention may further include at least one stub 230 to provide for further antenna matching. Each of the one or more stubs 230 is a line (or a dimensional structure) which is installed by connection with the metal edge 110. Also, each of the one or more stubs 230 is a line (or a dimensional structure) which is installed on the ground surface 121 of the main board 120. The stub 230 may be vertically spaced from the slot 123. The stub 230 is used for impedance matching or selective filtering of signals.

In one aspect of the invention, the slot radiator 210 and the loop radiator 220 may have a mismatched resonant frequency, and, thus, the at least one stub 230 may correct the mismatched resonant frequency. A resonant frequency of the antenna device varies according to a length of each of the at least one stub 230, wherein a length of each of the at least one stub 230 may correspond to a wavelength or an operating frequency. For example, if the length of the at least one stub 230 is lengthened, a resonant frequency is decreased. Conversely, if the length of the stub 230 is shortened, the resonant frequency is increased.

Referring back to FIG. 2A, the main board 120 is a board equipped with basic circuits and components (not shown). The main board 120 sets an execution environment of the portable terminal and maintains information about the setting of the execution environment. The main board 120 allows the portable terminal to be safely operated, and smoothly performs data input and output of all elements or components installed in the portable terminal. The main board may include a controller, a microprocessor, a coprocessor, a memory, a Basic Input Output System (BIOS), a connection circuit, etc. (not shown). In general, the main board 120 has a ground surface 121 for reducing harmful effects, such as noise.

FIG. 3 to FIG. 6 represent perspective views of an antenna device for a portable terminal according to different aspects of a first embodiment of the present invention.

Generally, the antenna device described with regard to FIGS. 3-6, stub 230 may be presented as a bent metal plate element extending from metal edge 110 and, as illustrated, stub 230 may be implemented as a variety of sizes and shapes.

Figure 3:
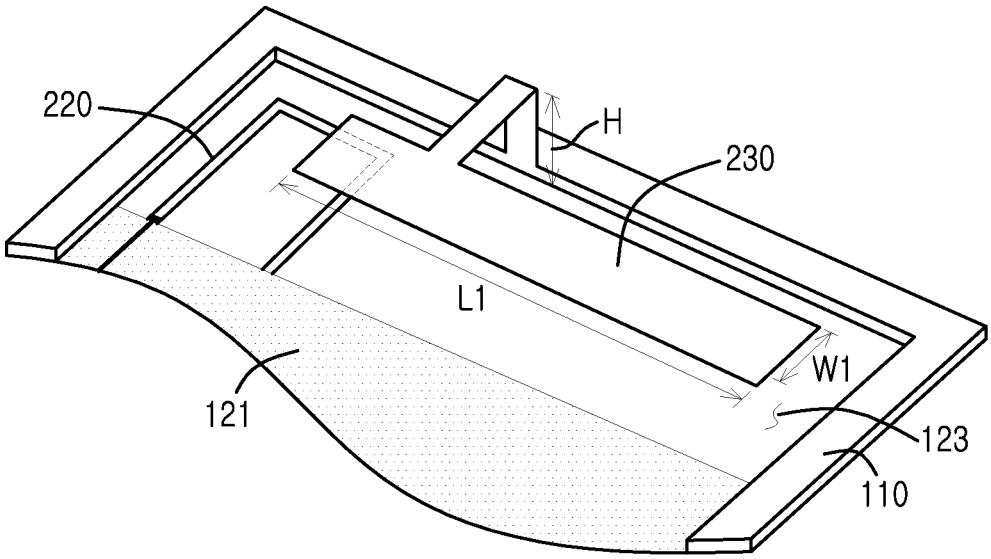
FIG. 3 to FIG. 6 are perspective views of different aspects of an antenna device according to a first embodiment of the present invention.

Referring to FIG. 3, stub 230 may be positioned to be vertically higher than the slot 123. Stub 230 is electrically connected to metal edge 110 and extends above the slot 123 by a distance (height) H. The stub 230 has a size (i.e., length (L1) and width (W1)) which are select or determined by the frequency (or range of frequencies) suitable for allowing frequency matching.

Figure 4:
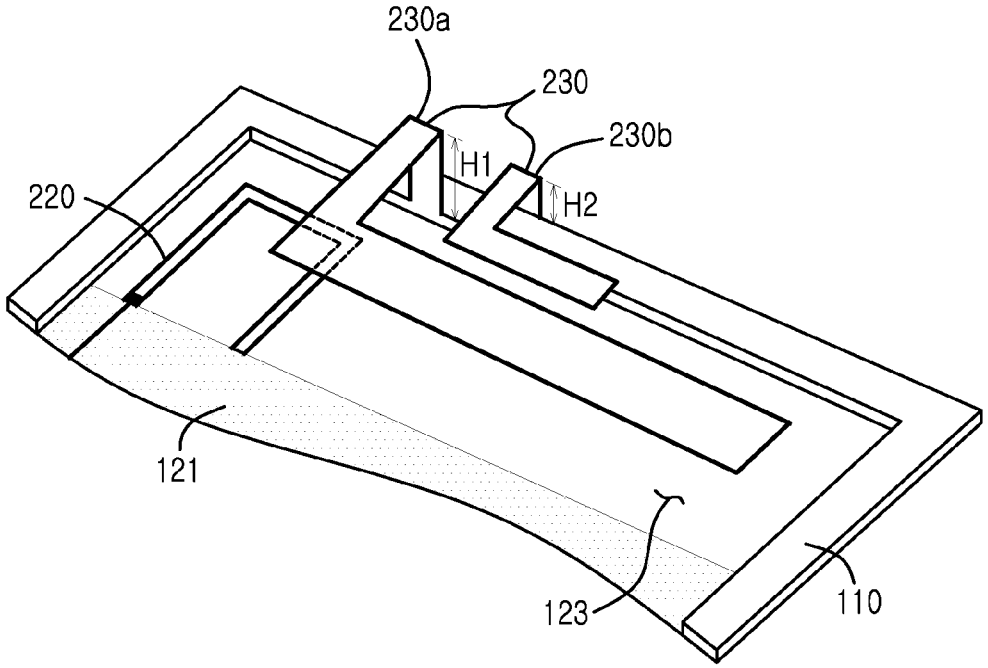

FIG. 4 illustrates a second aspect of a first embodiment of the invention, wherein two stubs 230 extend above the loop radiator 230. As illustrated, the two stubs are electrically connected to metal edge 110 and extend over slot 123. Each stub 230 is dimensionally sized (i.e., length and width) to provide for satisfactory antenna performance and matching characteristics (e.g., receiving and transmission characteristics).

In addition to the dimensional size of each stub 230 being different, the height of each stub 230 above the slot 123 may be different. In this illustrated example, one stub 230 (labeled 230*a*) extends at a height H1 above the slot 123, while the second stub 230 (labeled 230*b*) extends at a height H2 above the slot 123.

Figure 5:
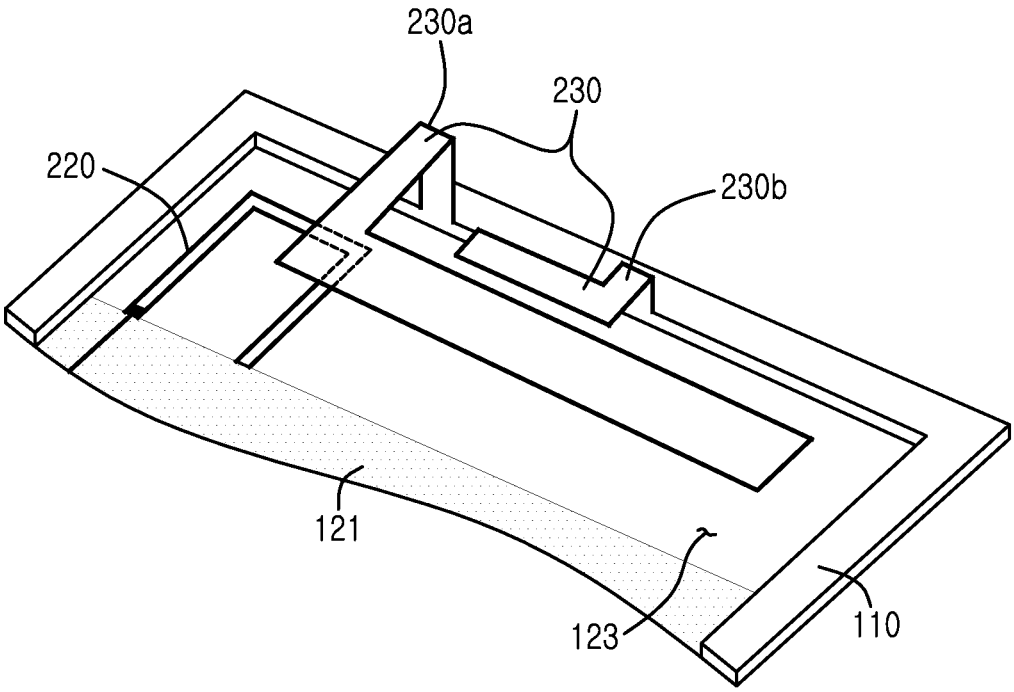

FIG. 5 illustrates a third aspect of a first embodiment of the invention, wherein two stubs 230 are arranged extending over slot 123 as previously described. In this case, the second stub 230 (i.e., 230*b*) is attached to an inner surface of metal edge 110 and the flat, dimensional, portion of the stub 230 extends towards the loop radiator 220.

Figure 6:
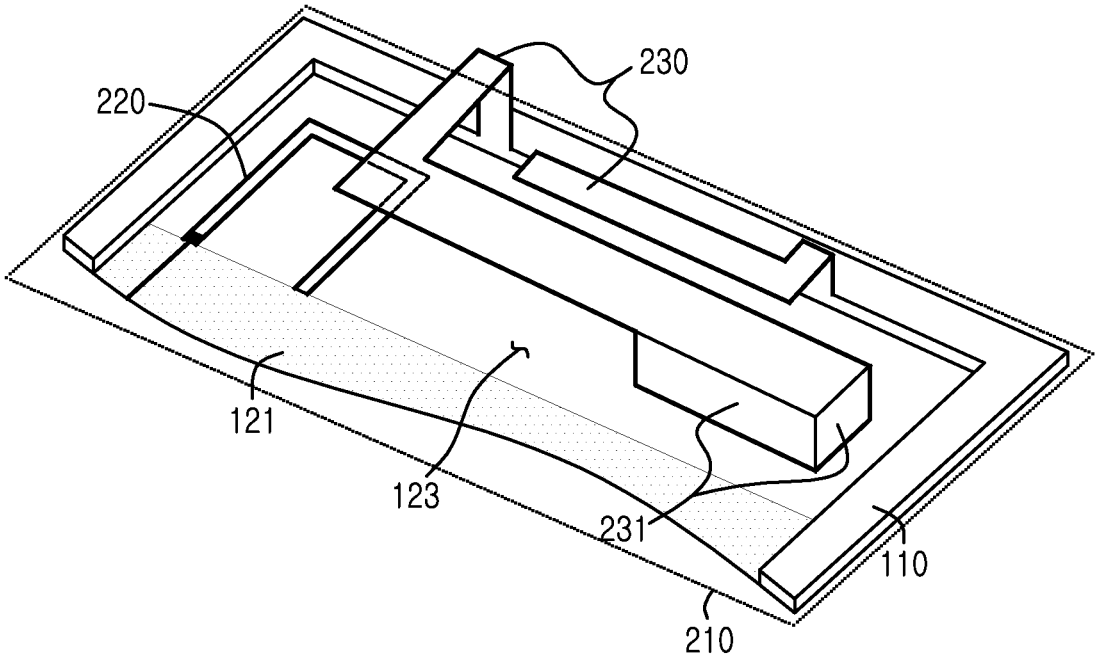

Referring to FIG. 6, at least one or more stubs 230 are positioned to be vertically higher than the slot 123, as previously described. One of at least one or more stubs 230 may include an end portion 231 bent to engage the slot 123. The bent end portion 231 contributes to driving the stub 230 as a capacitive element. For example, a resonant frequency of the antenna device may be lowered by the bent end portion 231, which engages or contacts the slot 123.

Figure 9:
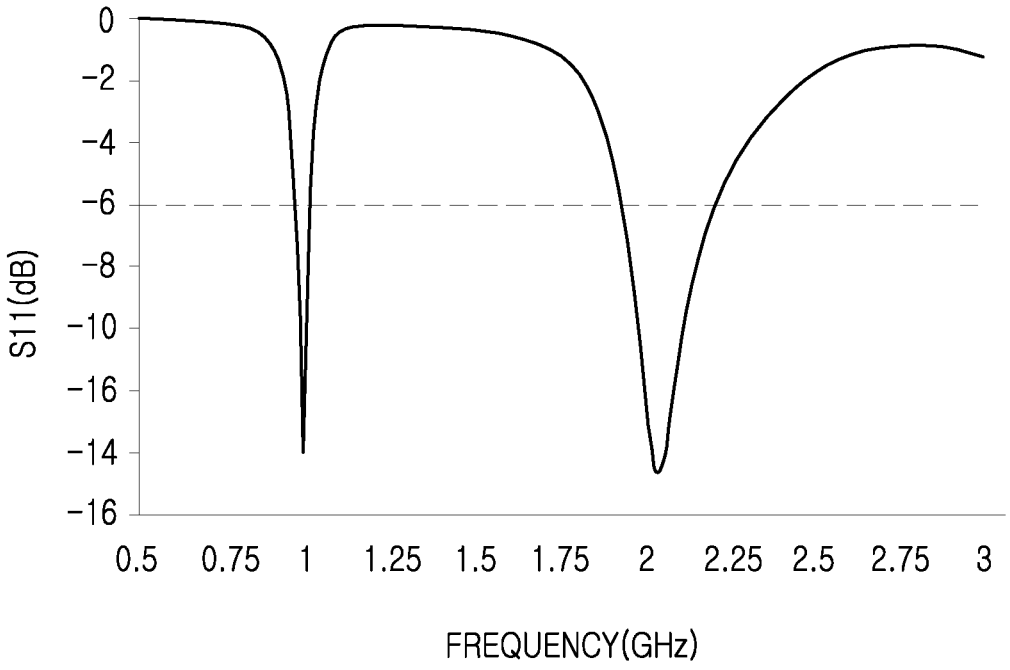
FIG. 9 presents a graph illustrating antenna performance of an antenna device shown in FIG. 6.

FIG. 9 is a graph illustrating antenna performance of an antenna device shown in FIG. 6 incorporated into a portable device according to the first embodiment of the present invention. In general, if a return loss S11 is −6 dB or less, it is easy to transmit and receive signals. Referring to FIG. 9, because the return loss around desired resonant frequencies 1 GHz and 2 GHz is −6 dB or less, resonance in a double band is good.

Figure 7A:
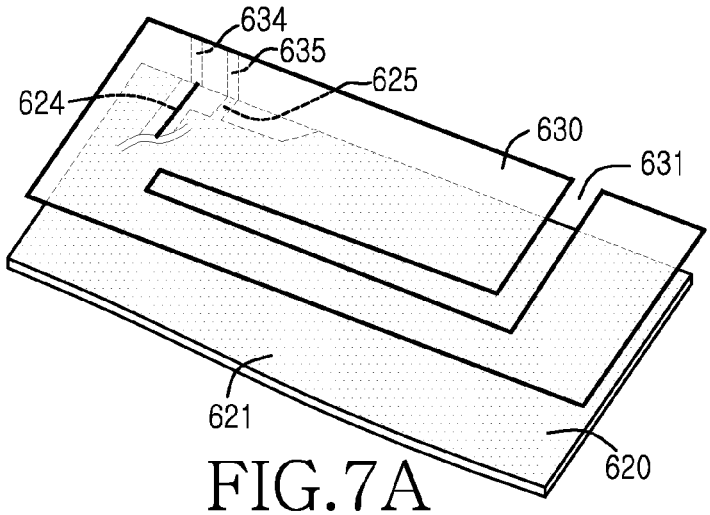
FIG.7A (PRIOR ART)
FIG. 7A illustrates a perspective view of a conventional PIFA antenna.

FIG. 7A represents a perspective view of a conventional double band Planar Inverted-F Antenna (PIFA) device.

In FIG. 7A, the conventional PIFA device includes a radiation plate 630 equipped with a slot 631 and a main board 620 which is spaced apart from the radiation plate 630 and is electrically connected with the radiation plate 630. The main board 620 includes a power supply end 624 for supplying a current (power) and a ground end 625 connected with a ground surface 621. The radiation plate 630 includes a power supply pin 634 electrically connected with the power supplying end 624 and a ground pin 635 electrically connected with the ground end 625.

Figure 7B:
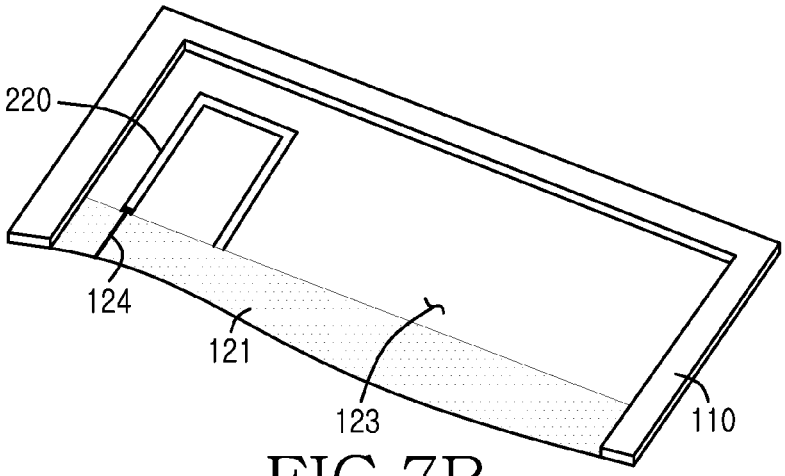
FIGS. 7B-7C illustrate a structure of an antenna device for a portable terminal according to a second embodiment of the present invention.
Figure 7C:
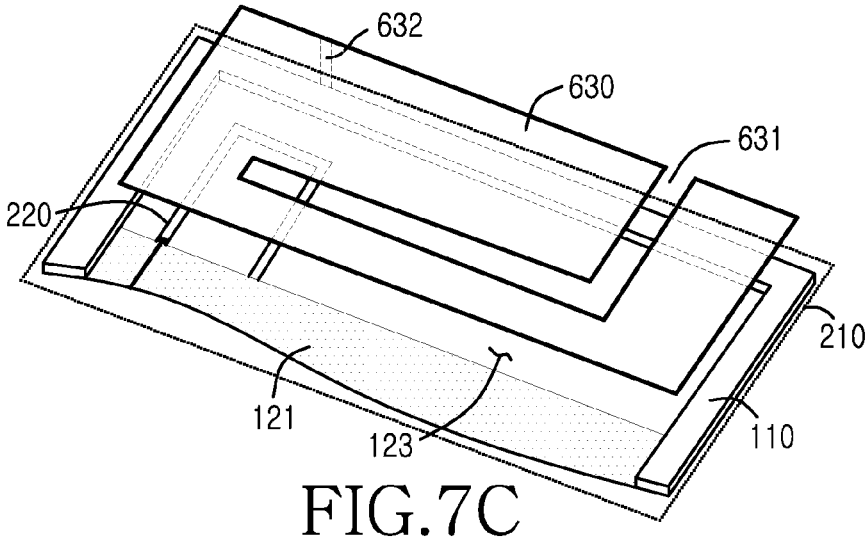

FIGS. 7B and 7C represent perspective views of an antenna device for a portable terminal according to a second embodiment of the present invention.

FIG. 7B illustrates an antenna device for the portable terminal similar to that shown in FIG. 2A. As previously discussed, the slot radiator 210 is magnetically coupled by the loop radiator 220. A detailed description for the slot radiator 210 and the loop radiator 220 will be omitted as a description of the slot radiator 210 and loop radiator 220 have been presented with reference to FIG. 2A and need not be presented again herein.

FIG. 7C is a perspective view of an antenna device for a portable terminal according to a second embodiment of the present invention.

The antenna device shown in FIG. 7C has a structure in which the radiator plate 630 of FIG. 7A and the antenna device of FIG. 7B are integrated.

FIG. 7C illustrates an antenna device for the portable terminal according to a second embodiment of the present invention that includes the slot radiator 210, the radiation plate 630, and the loop radiator 220. The loop radiator 220 magnetically couples the slot radiator 210 and the radiation plate 630. The ground surface 121 of the main board and the metal edge 110 of the case frame are electrically coupled at an intersection of the slot 123, and the slot radiator 210, as previously described.

The radiation plate 630 is equipped with slot 631 and is vertically spaced apart from the slot radiator 210. The radiation plate 630 is electrically connected to either the metal edge 110 of the slot radiator 210 or the ground surface 121 of the main board using a means 632. For example, means 632 may be an electrically conductive element that extends from either the metal edge 110 or the ground surface 121.

In the antenna device shown in FIG. 7C, the antenna device may resonate at a wideband. For example, the radiation plate 630 resonates at 900 MHz and 1800 MHz, and the slot radiator 210 may resonate at 1900 MHz in addition to 900 MHz and 1800 MHz.

Figure 8:
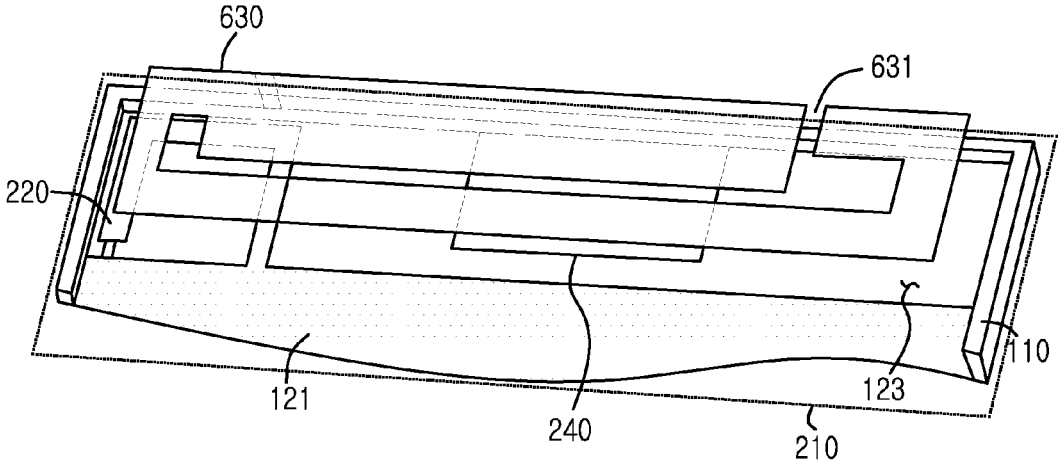
FIG. 8 illustrates a perspective view of an antenna device for a portable according to a second aspect of the second embodiment of the present invention.

FIG. 8 is a perspective view of an antenna device for a portable terminal according to a second aspect of the second embodiment of the present invention.

The antenna device for the portable terminal shown in FIG. 8 has the structure of the antenna device similar to that shown in FIG. 7C, wherein a radiation plate 630 having a slot 631 extends over the slot 123.

Referring to FIG. 8, the antenna device for the portable terminal according to this second aspect of the second embodiment of the present invention includes the slot radiator 210, the radiation plate 630, and the loop radiator 220, as previously described. The loop radiator 220 magnetically couples the slot radiator 210 and the radiation plate 630. The ground surface 121 of the main board and the metal edge 110 of the case frame are electrically coupled.

The radiation plate 630 is equipped with slot 631, and is vertically spaced apart from the slot radiator 210, as previously described. The radiation plate 630 is electrically connected with the metal edge 110 of the slot radiator 210 or the ground surface 121 of the main board using the means 632 (which is shown in FIG. 7C). Particularly, the antenna device may further include a metal patch 240 disposed on the slot 123 to electrically lengthen the slot 123 of the slot radiator 210 and secure a desired resonant length. The metal patch 240 is electrically connected with the metal edge 110 of the slot radiator 210, but is not directly electrically connected with the ground surface 121 of the main board.

The metal patch 240 may be deposited on the main board. Also, the metal patch 240 may have a variety of shapes such as a quadrilateral, a triangle, and a circle. The antenna device of FIG. 8 may resonate over a broad bandwidth. For example, the radiation plate 630 may resonate at 1 GHz and 1.8 GHz, and the slot radiator 210 which is lengthened by a length of the slot 123 due to the metal patch 240 may resonate at 2 GHz.

Figure 10:
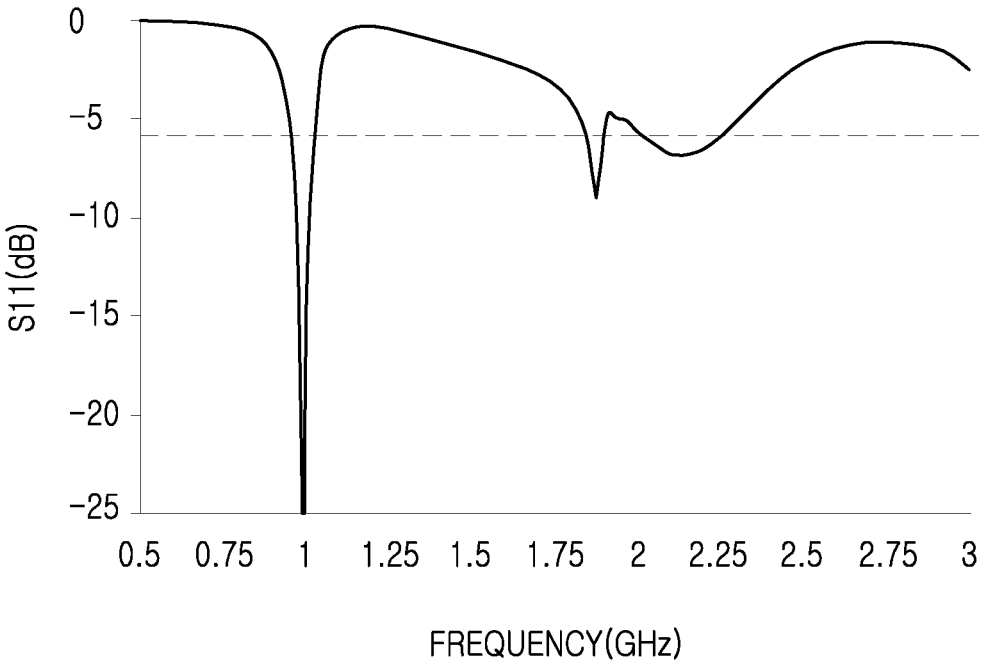
FIG. 10 presents a graph illustrating antenna performance of an antenna device of an antenna device shown in FIG. 8.

FIG. 10 is a graph illustrating antenna performance of the antenna device shown in FIG. 8 according to a second aspect of the second embodiment of the present invention.

Referring to FIG. 10, a frequency band with a return loss S11 of −6 dB or less is around 900 MHz and around 1.7 GHz to 2.2 GHz. Accordingly, the antenna device according to the second embodiment of the present invention may be applied to a portable terminal for a triple band or a quad band In conclusion, the antenna device according to an embodiment of the present invention allows the metal edge, which is mounted on the case frame, to be incorporated into the electrical elements of the portable device to enhance antenna performance.

Although the exemplary embodiments of the invention presented herein illustrate stub 230 being vertically displaced from the slot 123 and the loop radiator 220 being positioned on the slot 123, it would be recognized that the antenna device described herein may include a configuration in which the stubs 230 are positioned on the slot 123 and the loop radiator 220 may be vertically positioned above the slot 123.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. An antenna device for a portable terminal, the antenna device comprising:

a main board equipped with a power supply end for supplying power and a ground surface for grounding the main board;

a loop radiator connected to the power supply end of the main board at a first end and connected to the ground surface of the main board at a second end; and a metal body disposed along an outside edge of the portable terminal, the metal body being electrically connected to the ground surface of the main board, wherein a slot is defined by a portion of the ground surface and a proximate portion of the metal body to thereby form a slot radiator, the loop radiator being disposed within the slot and magnetically exciting the slot radiator.

2. The antenna device of claim 1, wherein the loop radiator is deposited on an ungrounded surface of the main board.

3. The antenna device of claim 1, further comprising at least one open-ended stub electrically connected to one of the metal body and the ground surface of the main board, the at least one open-ended stub changing a resonant frequency together generated by the loop radiator and the slot radiator.

4. The antenna device of claim 3, wherein each of the at least one open-ended stub is positioned within a lateral boundary of the slot.

5. The antenna device of claim 3, wherein each of the at least one open-ended stub comprises an end portion bent to extend laterally within the slot.

6. The antenna device of claim 3, wherein each of the at least one stub is deposited on an ungrounded surface of the main board.

7. The antenna device of claim 3, wherein the at least one open-ended stub is electrically connected to, and extends from, the metal body.

8. The antenna device of claim 1, further comprising a radiation plate, equipped with a second slot, the radiation plate being electrically connected with one of the metal body and the ground surface of the main board and vertically spaced apart from the slot.

9. The antenna device of claim 1, further comprising a metal patch which is positioned within lateral boundaries of the slot and is electrically connected with the metal body, wherein the metal patch is positioned on an ungrounded surface of the main board.

10. The antenna device of claim 9, wherein the metal patch has a quadrilateral shape.

11. The antenna device of claim 1, wherein the metal body is installed as a closed loop disposed on the outside edge of the portable terminal.

12. The antenna device of claim 1, wherein the loop radiator and slot radiator together form an antenna that resonates at least two frequencies.

13. The antenna device of claim 1, wherein the antenna device resonates at least one frequency selected from a group consisting of: 850 MHz, 900 MHz, 1800 MHz, 1900 MHz, and 2100 MHz.

14. The antenna device of claim 1, wherein the loop radiator has a quadrilateral shape.

15. The antenna device of claim 1, wherein the slot is represented as a quadrilateral.

16. A portable terminal comprising an antenna device, the antenna device comprising:

a main board equipped with a power supply end for supplying power and a ground surface for grounding the main board;

a loop radiator connected to the power supply end of the main board at a first one end and connected to the ground surface of the main board at a second end;

a metal body disposed along an outside edge of the portable terminal, the metal body being electrically connected to the ground surface of the main board, a slot surrounded by the ground surface of the main board and the metal body; and at least one open-ended stub electrically connected to one of the metal body and the ground surface of the main board, wherein the loop radiator is positioned on the main board and at least a portion of the stub being vertically spaced from the loop radiator.

17. The portable terminal of claim 16, wherein the antenna device further comprises:

a metal patch positioned within the slot and electrically connected to the metal body.

18. The portable terminal of claim 16, wherein the at least one open-ended stub is electrically connected to, and extends from, the metal body.

19. A portable terminal comprising an antenna device, the antenna device comprising:

a main board equipped with a power supply end for supplying power and a ground surface for grounding the main board;

a loop radiator connected to the power supply end of the main board at a first end and connected to the ground surface of the main board at a second end:

a metal body disposed along an outside edge of the portable terminal, the metal body being electrically connected to the ground surface of the main board, wherein a first slot is defined by a portion of the ground surface and a proximate portion of the metal body to thereby form a slot radiator, the loop radiator being disposed within the first slot and magnetically exciting the slot radiator; and a radiation plate, containing a second slot therein, the radiation plate being vertically spaced apart from the loop radiator and electrically connected with one of the metal body and the ground surface of the main board.

20. The portable terminal of claim 19, wherein the antenna device further comprises:

an open-ended metal patch positioned on the main board, the metal patch electrically connected with the metal body.

* * * * *

UNITED STATES PATENT AND TRADEMARK OFFICE

CERTIFICATE OF CORRECTION

PATENT NO. : 8,854,267 B2
APPLICATION NO. : 13/440283
DATED : October 7, 2014
INVENTOR(S) : Jae-Hee Kim et al.

It is certified that error appears in the above-identified patent and that said Letters Patent is hereby corrected as shown below:

IN THE CLAIMS:
Column 9, Claim 19, Lines 8-9 should read as follows:
--…second end; a metal…--

Signed and Sealed this
Sixth Day of January, 2015

Michelle K. Lee

Michelle K. Lee
*Deputy Director of the United States Patent and Trademark Office*